US008857664B2

(12) United States Patent
Pellingra et al.

(10) Patent No.: US 8,857,664 B2
(45) Date of Patent: Oct. 14, 2014

(54) TUBE WITH GUSSETS

(71) Applicant: Ampac Holdings LLC, Cincinnati, OH (US)

(72) Inventors: Salvatore Pellingra, Newport, KY (US); Allyson Smith, Cincinnati, OH (US)

(73) Assignee: Ampac Holdings LLC, Cincinnati, OH (US)

( * ) Notice: Subject to any disclaimer, the term of this patent is extended or adjusted under 35 U.S.C. 154(b) by 0 days.

(21) Appl. No.: 13/673,497

(22) Filed: Nov. 9, 2012

(65) Prior Publication Data

US 2013/0119086 A1 May 16, 2013

Related U.S. Application Data

(60) Provisional application No. 61/558,658, filed on Nov. 11, 2011.

(51) Int. Cl.

| | |
|---|---|
| ***B65D 35/00*** | (2006.01) |
| ***B65D 35/08*** | (2006.01) |
| ***B31B 49/00*** | (2006.01) |
| ***B31B 1/00*** | (2006.01) |

(52) U.S. Cl.

CPC ..... *B65D 35/00* (2013.01); *B65D 35/08* (2013.01); *B31B 49/00* (2013.01); *B31B 2201/9085* (2013.01); *B31B 2201/226* (2013.01); *B31B 2217/062* (2013.01); *B31B 2217/108* (2013.01); *B31B 1/00* (2013.01)

USPC ..... 222/107; 206/277

(58) Field of Classification Search

CPC ..... B65D 35/00; B65D 35/02; B65D 35/04; B65D 35/06; B65D 35/08; B31B 49/00; B31B 1/00; B31B 2201/9085; B31B 2217/062; B31B 2201/226

USPC ..... 222/92–107; 206/277, 484; 383/80

See application file for complete search history.

(56) References Cited

U.S. PATENT DOCUMENTS

| | | | | |
|---|---|---|---|---|
| 3,866,800 A | | 2/1975 | Schmitt | |
| 4,227,614 A | | 10/1980 | Hollander, Jr. | |
| 4,639,251 A | * | 1/1987 | Kirkland | 604/260 |

(Continued)

FOREIGN PATENT DOCUMENTS

| | | | | |
|---|---|---|---|---|
| DE | 4321275 A1 | * | 1/1995 | 222/94 |
| FR | 2540073 | * | 1/1984 | 222/150 |
| WO | WO-94/19251 | * | 9/1994 | 222/94 |

OTHER PUBLICATIONS

International Search Report, Dated Jan. 28, 2013.

*Primary Examiner* — Lien Ngo
(74) *Attorney, Agent, or Firm* — Perman & Green, LLP

(57) ABSTRACT

Provided are tubes with gussets and methods of making such tubes. In one aspect, a tube with gussets includes a fitment with at least one substantially curved concave region, and a tube body joined to the fitment, wherein the tube body is interconnected at a first end to the fitment such as to form at least one side gusset along at least a portion of the length of the tube body and complementary to the at least one substantially curved concave region of the fitment, and wherein the tube body is sealed at a second end distant from the fitment. The tube with gussets allows for the thickness of the film used to form the tube body to be less than the film thickness for a comparably sized tube without the gussets due to the improved tube body stiffness.

38 Claims, 4 Drawing Sheets

(56) References Cited

U.S. PATENT DOCUMENTS

| | | | | | |
|---|---|---|---|---|---|
| 5,244,120 | A | * | 9/1993 | O'Meara | 222/94 |
| 5,318,203 | A | * | 6/1994 | Iaia et al. | 222/94 |
| 5,582,328 | A | * | 12/1996 | Brown | 222/23 |
| 5,690,764 | A | | 11/1997 | Dirksing et al. | |
| 5,702,033 | A | * | 12/1997 | Beaver | 222/94 |
| 6,321,944 | B1 | * | 11/2001 | Cetrangolo | 222/105 |
| 6,415,965 | B2 | | 7/2002 | Nyman et al. | |
| D476,558 | S | | 7/2003 | Cho et al. | |
| D482,606 | S | * | 11/2003 | Modjeski | D9/699 |
| 6,763,975 | B1 | * | 7/2004 | Lesher | 222/94 |
| D626,860 | S | | 11/2010 | Oates et al. | |
| D638,719 | S | | 5/2011 | Sander | |
| 8,273,280 | B2 | * | 9/2012 | Jonsson | 264/275 |
| 2011/0017772 | A1 | | 1/2011 | Jacoulet et al. | |
| 2011/0220652 | A1 | | 9/2011 | Corbett et al. | |

* cited by examiner

TUBE WITH GUSSETS

CROSS-REFERENCE TO RELATED APPLICATIONS

This is a Non-Provisional Application that claims priority to U.S. Provisional Application 61/558,658 filed Nov. 11, 2011, which is herein incorporated by reference.

BACKGROUND

1. Field

The present embodiment storage tubes and, more particularly, to a storage tube with side gussets.

2. Related Developments

Semi-rigid storage tubes have been used often in cosmetic, food and pharmaceutical application. Oftentimes, they are used as convenient ways to store and dispense a viscous liquid. Tubes are also often used because they provide a barrier to fats, oils, moisture, oxygen or light, while remaining flexible enough for easy dispensing of the product within, for example, through squeezing of a liquid through a fitment. Tubes are often comprised of a tube body portion that is often comprised of a generally thick gauge film. Oftentimes, the films used to form the tube body are often 8 or more thousands of an inch thick. Common materials used to form these films include polypropylene, high density polyethylene, polystyrene or other similar film materials. The thicker gauge films are often important because they allow the tube body to maintain its shape, especially inverted standing tubes, while the product inside diminishes with use.

It is desirable to have a storage tube which may use a thinner gauge film to form the tube body. For instance, a thinner gauge film allows for reduced material costs in manufacture and also for more efficient tube utilization. A thinner gauge material also allows for improvements in printing on the material, for example, making it easier to print on a larger portion of the body than would be possible for a thicker and more rigid material, or allowing for reverse printing on the material as well as allowing for 360 degree print graphics. A thinner gauge material may also allow for less costly transportation due to the reduced weight. A thinner gauge material may also allow for less costly transportation due to the reduced weight. A thinner gauge material may also help fulfill environmental sustainability goals by using less packaging material and producing less waste. Finally, thinner gauge materials allow for more complete product evacuation than similar rigid or semi-rigid containers. Because the material is flexible and thin, product can be almost completely squeezed out of a tube formed from flexible films, whereas up to 15% of product can be left inside similar rigid or semi-rigid containers depending on the viscosity of the product.

BRIEF DESCRIPTION OF THE DRAWINGS

The foregoing aspects and other features of the present disclosed embodiment are explained in the following description, taken in connection with the accompanying drawings, wherein.

DETAILED DESCRIPTION OF THE EXEMPLARY EMBODIMENTS

Figure 1:
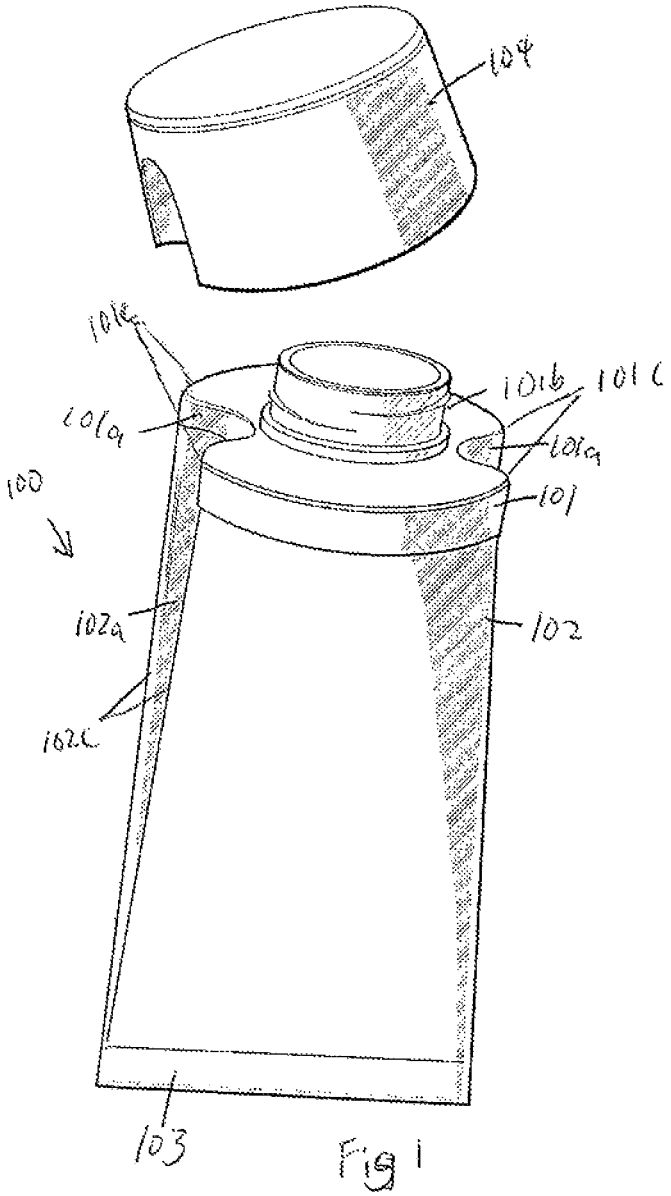
FIG. 1 is a perspective of an exemplary tube incorporating features in accordance with an exemplary embodiment.

FIG. 1 illustrates a perspective view of an exemplary tube 100 with side gussets. Although the aspects of the disclosed embodiment will be described with reference to the drawings, it should be understood that the aspects of the disclosed embodiment can be embodied in many alternate forms. In addition, any suitable size, shape or type of elements or materials could be used. For purposes of the present disclosure, side gussets of the exemplary tube are defined as substantially concave regions of the tube body where the tube body is pushed inwards towards the center of the tube along the side of the tube body.

Figure 4:
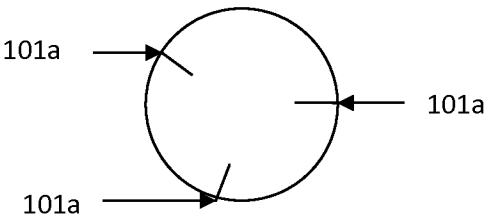
FIG. 4 is a schematic cross-sectional view of an exemplary tube with three substantially curved concave regions and three complementary side gussets depicted as lines (101*a*) and which are located about equidistant from one another.

Referring still to FIG. 1, a fitment 101 is shown. The fitment 101 may be formed out of any type of resin material, for example, polypropylene, high density polyethylene, molded pulp or any other suitable rigid material for forming the fitment 101. In alternate aspects, any sort of suitable rigid material may be used to form the fitment 101. The fitment 101 may have a dispensing portion 101*b*. The exemplary dispensing portion 101*b* shown in FIG. 1 is a spout, however, in alternate aspects, any suitable opening to allow for a viscous or flowable product to be dispensed may be used. For example, in alternate aspects, the dispensing portion 101*b* may be a hole or an aperture instead of a spout as shown. Fitment 101 may also function as a retaining piece having two concave regions 101*a*. In alternative aspects, the fitment may have one, or two, or three (see FIG. 4), or four concave regions which would result in the corresponding number of side gussets (one to four) in the tube. Generally, the concave regions may be curved, for example, with an apex surface that may be partially circular or near circular in shape. In alternate aspects of the disclosed embodiments, the concave region may take any suitable shape, for instance a deeper, more oval concave shape, a more parabolic shape, or a shallower concave shape, or any suitable shape with a rounded contour that may be blended smoothly at the opening of the concave regions (e.g. the shoulders 101*c*) into the outer periphery of the fitment 101. The shoulders 101*c* may be generally rounded at the point of transition between the concave region 101*a* and the outer periphery of the fitment 101. In alternate aspects of the disclosed embodiment, the shoulders 101*c* may take any other suitable shape, including a flat, square, or less rounded shape at the transition to facilitate blending of the concave region 101*a* to the periphery of the fitment 101. Generally, the concave regions 101*a* are located on opposing sides of the fitment 101 and may be complementary, although it is contemplated that there could only be one concave region 101*a* or the regions could be severely offset depending on the structure and desired features of the final package, as will be discussed below, with concave portions (i.e. side gussets) 102*a* of the tube body 102.

The fitment 101 may be further configured to be closed by means of a cap 104. In one aspect of the disclosed embodiment, the cap may be a screw-on cap, but as can be understood, the cap 104 may take any suitable shape known in the art, including a cap that uses mechanical coupling, or hinged caps formed as part of the fitment 101 or any other suitable cap types.

The fitment may also be joined to a tube body 102. The tube body 102 may be formed from, for instance, a monolayer film, a coextruded film, or a multilayer laminated film or a film in film type construction (i.e. structural film on outside and barrier film on inside) or any other suitable thin film material. A monolayer film may be formed from, for instance, a blown film or a cast film comprising of polypropylene, polyethylene, nylon, or any other suitable materials for use in a film. In alternate aspects, a monolayer film may be formed from any suitable material by any suitable means. The monolayer film may also have additives included for improved processing or physical characteristics of the resultant monolayer film. For example, monolayer films may also be formed with additives which modify transparency, feel, print quality, or barrier properties of the film, or any other suitable film characteristics which may be desirable. A tube body 102 may also be formed from a coextruded film. A coextruded film may be formed from blown film or a cast film and may further use combinations of resin types which are coextruded to form multiple layers. The film materials used to form a coextruded film may include polypropylene, polyethylene, nylon, or ethylene vinyl alcohol, or any other suitable film material. The film materials may be combined in multiple layers in any suitable configuration for desirable characteristics of the resultant coextruded film. A coextruded film may have any suitable number of layers. The tube body 102 may also be formed from a laminated film. Laminated films may be comprised of a combination of co-extruded and/or monolayer films similar to those discussed previously. A laminated film may be laminated by any suitable lamination technology, including, but not limited to, extrusion, thermal bonding, and solvent or solventless lamination technologies. In alternate aspects, any suitable means of lamination of films may be used. The lamination configuration may be adjustable so that the resultant film may have desirable characteristics, for instance barrier properties, coefficient of friction, print layer characteristics, varnish, texture, and any other suitable characteristics desirable in a resultant film.

Referring still to FIG. 1, the tube body 102 may have two side gussets 102*a* substantially arranged on opposing sides of the tube body 102. The two side gussets 102*a* are substantially concave regions of the tube body where the tube body 102 is pushed inwards towards the center of the tube along the side of the tube body 102. The side gussets 102*a* may be substantially complementary with the concave regions 101*a* within the fitment body 101 and may fit directly into the fitment body so that the tube body 102 may allow for a flush or complementary surface with that of the fitment 101. In alternate aspects, the tube body 102 may fit into the fitment body by any suitable means. The concave region formed by side gussets 102*a* creates areas in the film which is substantially doubled over or curved so as to increase the structural integrity formed for the pouch body, allowing the pouch to maintain its shape as the product within depletes. In particular, thickness of the thickness of the film used to form the tube with at least one side gusset may be at least 10% less, or at least 20% less, or at least 30% less, or at least 40% less, or at least 50% less than the film thickness for a comparably sized tube without the at least one side gusset formed along at least a portion of the length of the tube body. The thickness of the film for the tube body may range from 1 to 50 mil, or 2 to 40 mil, or 5 to 20 mil, or 10 to 15 mil.

Figure 5:
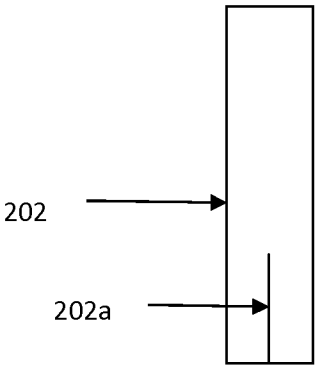
FIG. 5 is a schematic frontal view of an exemplary tube body with side gussets depicted as line (202*a*) with the side gussets formed along about one-third of the length of the tube body (202).
Figure 6:
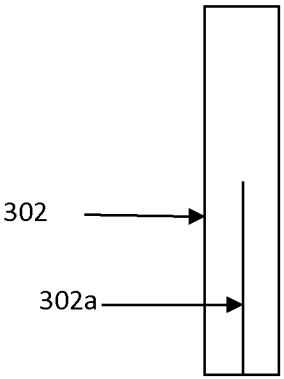
FIG. 6 is a schematic frontal view of an exemplary tube body with side gussets depicted as line (302*a*) with the side gussets formed along about one-half of the length of the tube body (302).
Figure 7:
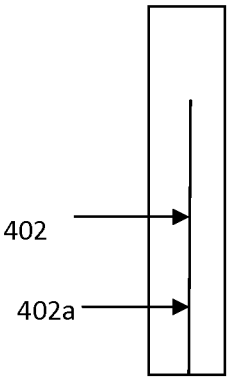
FIG. 7 is a schematic frontal view of an exemplary tube body with side gussets depicted as line (402*a*) with the side gussets formed along about two-thirds of the length of the tube body (402).

Still referring to FIG. 1, in one aspect of the disclosed embodiment, the side gussets 102*a* may be defined between two gusset shoulders 102*c* which may be substantially complementary with shoulders 101*c* and may allow for a substantially smooth transition from the periphery of the tube body 102 to the side gussets 102*a*. The side gussets 102*a* may, in one aspect of the disclosed embodiments, may run substantially the length of the tube body 102. In alternate aspects, the side gussets 102*a* may run partially along the length of the tube body 102. For example, in FIG. 5, the side gussets 202*a* run along about one-third of the length of the tube body 202. Alternatively, in FIG. 6, the side gussets 302*a* run along about one-half of the length of the tube body 302. Still alternatively, in FIG. 7, the side gussets 402*a* run along about two-thirds of the length of the tube body 402. In yet alternate aspects, the side gussets 102*a* may taper, that is, become shallower or deeper as it runs along the length of the tube body 102. In yet other aspects, the side gussets 102*a* may be formed as a crease along the side of the tube body 102. The tube body 102 may be bonded to the fitment 101 through a variety of means. For instance, the tube body 102 may be heat-bonded to the fitment 101 or glued to the fitment 101. In alternate aspects, the tube body 102 may also be joined to the fitment 101 through the means of a snap band (i.e. a mechanical connection of any suitable sort) or any other suitable means of bonding. The top of the tube body 101 (i.e. the portion of the tube body 102 opposing the connection with fitment 101) may be left open during manufacturing to allow for filling through the top of the tube body 102. Subsequently, the tube body 102 may be sealed at tube end 105. In alternate aspects, the top of the tube body 102 may be sealed during manufactured by means of tube end 105 so that filling of the tube body may be achieved through the fitment 101. The tube end 105 may be sealed by any suitable means, including heat, glue, ultrasonic, RF or any other means by which the tube may be sealed.

Figure 2:
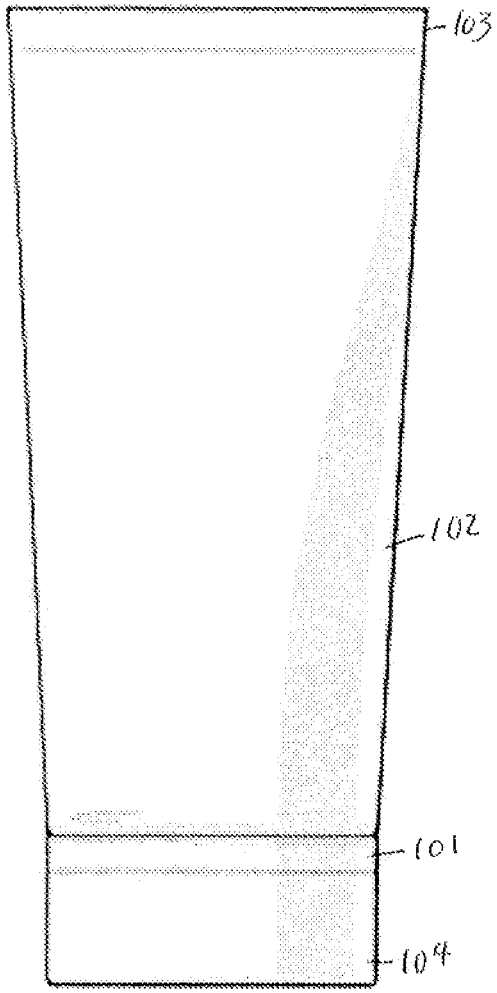
FIG. 2 is a front elevation view of the exemplary tube.
Figure 3:
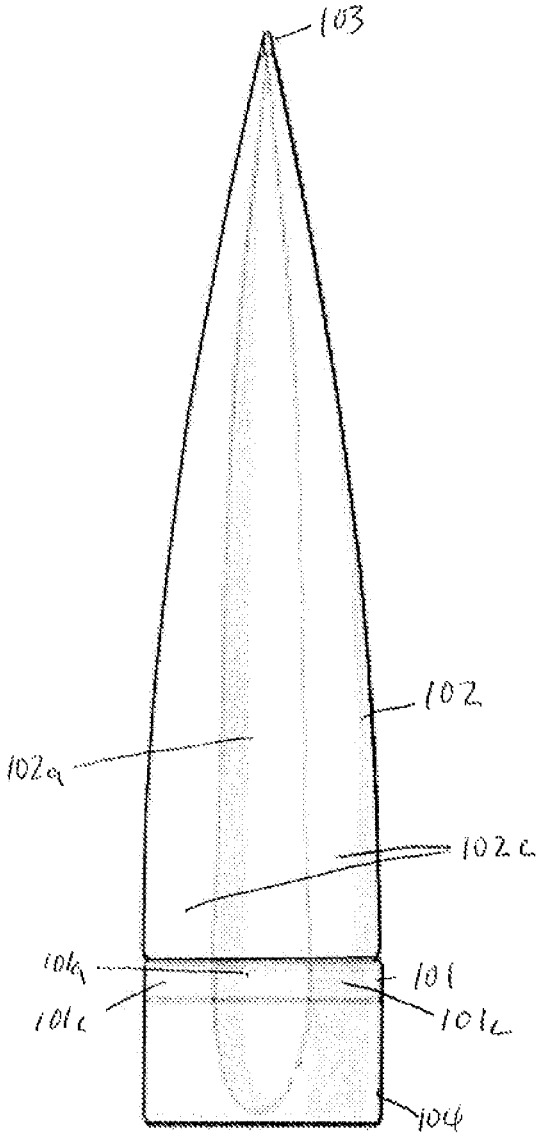
FIG. 3 is a side elevation view of the exemplary tube.

Referring now to FIGS. 2 and 3, a front elevation and a side elevation view of the disclosed aspect is shown.

In accordance with one or more aspects of the disclosed embodiment, a tube with gussets comprises a fitment with at least one substantially curved concave region, and a tube body joined to the fitment, wherein the tube body is interconnected at a first end to the fitment such as to form at least one side gusset along at least a portion of the length of the tube body and complementary to the at least one substantially curved concave region of the fitment, and wherein the tube body is sealed at a second end distant from the fitment.

In accordance with another aspect of the disclosed embodiment, wherein the fitment further includes a dispensing portion.

In accordance with another aspect of the disclosed embodiment, wherein the dispensing portion is selected from the group consisting of spout, a hole or an aperture.

In accordance with another aspect of the disclosed embodiment, further including a cap interconnected to the fitment.

In accordance with another aspect of the disclosed embodiment, wherein the cap is interconnected to the fitment via a screw-on system, a hinged system or a mechanical coupling system.

In accordance with another aspect of the disclosed embodiment, wherein the fitment has one substantially curved concave region and the tube body has one complementary side gusset.

In accordance with another aspect of the disclosed embodiment, wherein the fitment has two substantially curved concave regions and the tube body has two complementary side gussets.

In accordance with another aspect of the disclosed embodiment, wherein the two substantially curved concave regions are located on opposing sides of the fitment.

In accordance with another aspect of the disclosed embodiment, wherein the fitment has three substantially curved concave regions and the tube body has three complementary side gussets.

In accordance with another aspect of the disclosed embodiment, wherein the three substantially curved concave regions are located about equidistant from one another on the fitment.

In accordance with another aspect of the disclosed embodiment, wherein the at least one side gusset is formed along substantially the entire length of the tube body.

In accordance with another aspect of the disclosed embodiment, wherein the at least one side gusset is formed along about one-third of the length of the tube body.

In accordance with another aspect of the disclosed embodiment, wherein the at least one side gusset is formed along about one-half of the length of the tube body.

In accordance with another aspect of the disclosed embodiment, wherein the at least one side gusset is formed along about two-thirds of the length of the tube body.

In accordance with another aspect of the disclosed embodiment, wherein the fitment is formed from polypropylene, polystyrene, polyester, nylon, polyethylene, polyhydroxyalkanoate, polylactic acid, polyester from sugar cane or corn derived ethanol or molded pulp.

In accordance with another aspect of the disclosed embodiment, wherein the tube body is formed from a film selected from the group consisting of a monolayer film, a coextruded film, a multilayer film, a laminated film or a film in film type construction.

In accordance with another aspect of the disclosed embodiment, wherein the film is formed from polypropylene, polystyrene, polyester, nylon, ethylene vinyl alcohol, polyethylene, polyhydroxyalkanoate, polylactic acid, polyester from sugar cane or corn derived ethanol, cellulose, aluminum foil or combinations thereof.

In accordance with another aspect of the disclosed embodiment, wherein the thickness of the film is at least 10% less than the film thickness for a comparably sized tube without the at least one side gusset formed along at least a portion of the length of the tube body.

In accordance with another aspect of the disclosed embodiment, wherein the tube body fits over the outside diameter of the fitment or the tube body fits within the inside diameter of the fitment.

In accordance with another aspect of the disclosed embodiment, further including a ring or split ring to fasten the tube body over the outside diameter of the fitment.

In accordance with another aspect of the disclosed embodiment, wherein the fitment further includes a recessed area in the outside diameter of the first end.

In accordance with another aspect of the disclosed embodiment, wherein the tube body is seated in the recessed area in the outside diameter of the fitment such the tube body is flush with the outside diameter of the fitment in the non-recessed area of the outer diameter of the fitment.

In accordance with another aspect of the disclosed embodiment, further comprising at least two fitment shoulders on either side of the at least one substantially curved concave region of the fitment.

In accordance with another aspect of the disclosed embodiment, further comprising at least two gusset shoulders on either side of the at least one side gusset.

In accordance with another aspect of the disclosed embodiment, wherein the at least two gusset shoulders are complementary to the at least two fitment shoulders.

In accordance with another aspect of the disclosed embodiment, wherein the at least one side gusset along at least a portion of the length of the tube body decreases in depth along the length of the tube body.

In accordance with another aspect of the disclosed embodiment, wherein the at least one side gusset along at least a portion of the length of the tube body increases in depth along the length of the tube body.

In accordance with another aspect of the disclosed embodiment, wherein the at least one side gusset further includes at least one crease or seal along at least a portion of the length of the tube body.

In accordance with another aspect of the disclosed embodiment, further including a hang hole in the second end of the sealed tube body.

In accordance with one or more aspects of the disclosed embodiment, a method of making a tube with gussets comprises: i) providing a fitment with at least one substantially curved concave region, and a tube body formed of a film; ii) joining one end of the fitment to a first end of the tube body such as to form at least one side gusset along at least a portion of the length of the tube body and complementary to the at least one substantially curved concave region of the fitment; and iii) sealing the tube body at a second end distant from the fitment to form a tube.

In accordance with another aspect of the disclosed embodiment, wherein the fitment further includes a dispensing portion selected from the group consisting of spout, a hole or an aperture.

In accordance with another aspect of the disclosed embodiment, further comprising providing a cap and interconnecting the cap to the fitment via a screw-on system, a hinged system or a mechanical coupling system.

In accordance with another aspect of the disclosed embodiment, wherein the tube body is printed.

In accordance with another aspect of the disclosed embodiment, wherein the film of the tube body is selected from the group consisting of a monolayer film, a coextruded film, a multilayer film, a laminated film and a film in film type construction.

In accordance with another aspect of the disclosed embodiment, wherein the film is formed from a method selected from the group consisting of monolayer blown film extrusion, monolayer cast film extrusion, multilayer blown film coextrusion, multilayer cast film coextrusion, extrusion lamination, thermal lamination, solvent adhesive lamination, solventless adhesive lamination, and combinations thereof.

In accordance with another aspect of the disclosed embodiment, wherein the sealing of the tube body at a second end distant from the fitment occurs by a method selected from group consisting of heating, gluing, ultrasonic, RF and combinations thereof.

In accordance with another aspect of the disclosed embodiment, further including filling the interior of the tube with a liquid, a solid or combinations thereof through the second end of the tube body distant from the fitment prior to the sealing step.

In accordance with another aspect of the disclosed embodiment, further including filling the interior of the tube with a liquid, a powdered solid or combinations thereof through the dispensing portion of the fitment.

In another aspect of the disclosed embodiment, a tube is disclosed. The tube having a retaining piece substantially defining at least one substantially curved concave region within the retaining piece and a tube body joined to the retaining piece so that the at least one substantially curved concave region of the retaining piece defines at least one tube gusset formed along the length of the tube body.

It should be understood that the foregoing description is only illustrative of the aspects of the disclosed embodiment and that the aspects of the disclosed embodiment can be used individually or in any suitable combination thereof. Various alternatives and modifications can be devised by those skilled in the art without departing from the aspects of the disclosed embodiment. Accordingly, the aspects of the disclosed embodiment are intended to embrace all such alternatives, modifications and variances that fall within the scope of the appended claims. Further, the mere fact that different features are recited in mutually different dependent or independent claims does not indicate that a combination of these features cannot be advantageously used, such a combination remaining within the scope of the aspects of the invention.

All patents, test procedures, and other documents cited herein, including priority documents, are fully incorporated by reference to the extent such disclosure is not inconsistent with this invention and for all jurisdictions in which such incorporation is permitted. When numerical lower limits and numerical upper limits are listed herein, ranges from any lower limit to any upper limit are contemplated.

What is claimed is:

1. A tube with gussets comprising a fitment with at least one substantially curved concave region, and a tube body with a single chamber joined to the fitment, wherein the tube body is interconnected at a first end to the fitment such as to form at least one side gusset along at least a portion of the length of the tube body and complementary to the at least one substantially curved concave region of the fitment, and wherein the tube body is sealed at a second end distant from the fitment, wherein the at least one side gusset is a substantially concave region of the tube body where the tube body is pushed inwards towards the center of the tube along a side of the tube body.

2. The tube of claim 1, wherein the fitment further includes a dispensing portion.

3. The tube of claim 2, wherein the dispensing portion is selected from the group consisting of spout, a hole or an aperture.

4. The tube of claim 3 further including a cap interconnected to the fitment.

5. The tube of claim 4, wherein the cap is interconnected to the fitment via a screw-on system, a hinged system or a mechanical coupling system.

6. The tube of claim 1, wherein the fitment has one substantially curved concave region and the tube body has one complementary side gusset.

7. The tube of claim 1, wherein the fitment has two substantially curved concave regions and the tube body has two complementary side gussets.

8. The tube of claim 7, wherein the two substantially curved concave regions are located on opposing sides of the fitment.

9. The tube of claim 1, wherein the fitment has three substantially curved concave regions and the tube body has three complementary side gussets.

10. The tube of claim 9, wherein the three substantially curved concave regions are located about equidistant from one another on the fitment.

11. The tube of claim 1, wherein the at least one side gusset is formed along substantially the entire length of the tube body.

12. The tube of claim 1, wherein the at least one side gusset is formed along about one-third of the length of the tube body.

13. The tube of claim 1, wherein the at least one side gusset is formed along about one-half of the length of the tube body.

14. The tube of claim 1, wherein the at least one side gusset is formed along about two-thirds of the length of the tube body.

15. The tube of claim 1, wherein the fitment is formed from polypropylene, polystyrene, polyester, nylon, polyethylene, polyhydroxyalkanoate, polylactic acid, polyester from sugar cane or corn derived ethanol or molded pulp.

16. The tube of claim 1, wherein the tube body is formed from a film selected from the group consisting of a monolayer film, a coextruded film, a multilayer film, a laminated film or a film in film type construction.

17. The tube of claim 16, wherein the film is formed from polypropylene, polystyrene, polyester, nylon, ethylene vinyl alcohol, polyethylene, polyhydroxyalkanoate, polylactic acid, polyester from sugar cane or corn derived ethanol, cellulose, aluminum foil or combinations thereof.

18. The tube of claim 16 wherein the thickness of the film is at least 10% less than the film thickness for a comparably sized tube without the at least one side gusset formed along at least a portion of the length of the tube body.

19. The tube of claim 1, wherein the tube body fits over the outside diameter of the fitment or the tube body fits within the inside diameter of the fitment.

20. The tube of claim 19, further including a ring or split ring to fasten the tube body over the outside diameter of the fitment.

21. The tube of claim 1, wherein the fitment further includes a recessed area in the outside diameter of the first end.

22. The tube of claim 21, wherein the tube body is seated in the recessed area in the outside diameter of the fitment such the tube body is flush with the outside diameter of the fitment in the non-recessed area of the outer diameter of the fitment.

23. The tube of claim 1 further comprising at least two fitment shoulders on either side of the at least one substantially curved concave region of the fitment.

24. The tube of claim 23 further comprising at least two gusset shoulders on either side of the at least one side gusset.

25. The tube of claim 24 wherein the at least two gusset shoulders are complementary to the at least two fitment shoulders.

26. The tube of claim 1 wherein the at least one side gusset along at least a portion of the length of the tube body decreases in depth along the length of the tube body.

27. The tube of claim 1 wherein the at least one side gusset along at least a portion of the length of the tube body increases in depth along the length of the tube body.

28. The tube of claim 1 wherein the at least one side gusset further includes at least one crease or seal along at least a portion of the length of the tube body.

29. The tube of claim 1 further including a hang hole in the second end of the sealed tube body.

30. A method of making a tube with gussets comprising: i) providing a fitment with at least one substantially curved concave region, and a tube body with a single chamber formed of a film; ii) joining one end of the fitment to a first end of the tube body such as to form at least one side gusset along at least a portion of the length of the tube body and complementary to the at least one substantially curved concave region of the fitment; and iii) sealing the tube body at a second end distant from the fitment to form a tube, wherein the at least one side gusset is a substantially concave region of the tube body where the tube body is pushed inwards towards the center of the tube along a side of the tube body.

31. The method of claim 30, wherein the fitment further includes a dispensing portion selected from the group consisting of spout, a hole or an aperture.

32. The method of claim 31 further comprising providing a cap and interconnecting the cap to the fitment via a screw-on system, a hinged system or a mechanical coupling system.

33. The method of claim 30 wherein the tube body is printed.

34. The method of claim 30 wherein the film of the tube body is selected from the group consisting of a monolayer film, a coextruded film, a multilayer film, a laminated film and a film in film type construction.

35. The method of claim 34 wherein the film is formed from a method selected from the group consisting of monolayer blown film extrusion, monolayer cast film extrusion, multilayer blown film coextrusion, multilayer cast film coextrusion, extrusion lamination, thermal lamination, solvent adhesive lamination, solventless adhesive lamination, and combinations thereof.

36. The method of claim 30 wherein the sealing of the tube body at a second end distant from the fitment occurs by a method selected from group consisting of heating, gluing, ultrasonic, RF and combinations thereof.

37. The method of claim 30 further including filling the interior of the tube with a liquid, a solid or combinations thereof through the second end of the tube body distant from the fitment prior to the sealing step.

38. The method of claim 31 further including filling the interior of the tube with a liquid, a powdered solid or combinations thereof through the dispensing portion of the fitment.

* * * * *